US011545761B2

(12) United States Patent
He et al.

(10) Patent No.: US 11,545,761 B2
(45) Date of Patent: Jan. 3, 2023

(54) DUAL-BAND CROSS-POLARIZED 5G MM-WAVE PHASED ARRAY ANTENNA

(71) Applicant: Mobix Labs, Inc., Irvine, CA (US)

(72) Inventors: Ziming He, Irvine, CA (US); Oleksandr Gorbachov, Irvine, CA (US)

(73) Assignee: Mobix Labs, Inc., Irvine, CA (US)

( * ) Notice: Subject to any disclaimer, the term of this patent is extended or adjusted under 35 U.S.C. 154(b) by 74 days.

(21) Appl. No.: 17/233,784

(22) Filed: Apr. 19, 2021

(65) Prior Publication Data

US 2021/0367358 A1 Nov. 25, 2021

Related U.S. Application Data

(60) Provisional application No. 63/028,788, filed on May 22, 2020.

(51) Int. Cl.
*H01Q 25/00* (2006.01)
*H01Q 9/04* (2006.01)
*H01Q 21/06* (2006.01)

(52) U.S. Cl.
CPC ..... *H01Q 25/001* (2013.01); *H01Q 9/0414* (2013.01); *H01Q 21/065* (2013.01)

(58) Field of Classification Search
CPC ..... H01Q 5/30; H01Q 5/375; H01Q 5/385; H01Q 25/001; H01Q 9/04; H01Q 9/0407; H01Q 9/0414; H01Q 21/06; H01Q 21/061; H01Q 21/065; H01Q 19/005
See application file for complete search history.

(56) References Cited

U.S. PATENT DOCUMENTS

2009/0322642 A1 12/2009 Foo
2015/0022416 A1* 1/2015 Sasaki ..... H01Q 9/0407 343/841
2017/0012359 A1* 1/2017 Jung ..... H01Q 21/065
2017/0317402 A1 11/2017 Hwang et al.
2018/0352651 A1 12/2018 Tazzoli et al.
(Continued)

OTHER PUBLICATIONS

PCT Search Report & Written Opinion for PCT/US2021/033392; dated Aug. 20, 2021.
(Continued)

*Primary Examiner* — Jason Crawford
(74) *Attorney, Agent, or Firm* — Stetina Brunda Garred & Brucker

(57) ABSTRACT

A dual-band cross-polarized antenna includes first and second metal layers defining respective first and second driven patches configured to radiate at different frequencies, first and second feed pins connecting a first feed line to the first driven patch at respective first and second feed points thereof associated with orthogonal polarizations, and third and fourth feed pins connecting a second feed line to the second driven patch at first and second feed points thereof associated with orthogonal polarizations. The third feed pin extends through a first hole in the first driven patch to capacitively couple the third feed pin to the first driven patch. The fourth feed pin extends through a second hole in the first driven patch to capacitively couple the fourth feed pin to the first driven patch. Two or more antenna elements are arranged as a phased array antenna and packaged as an antenna module.

20 Claims, 8 Drawing Sheets

(56) References Cited

U.S. PATENT DOCUMENTS

| | | | | |
|---|---|---|---|---|
| 2018/0358701 | A1* | 12/2018 | Gimersky | H01Q 9/0414 |
| 2019/0020110 | A1* | 1/2019 | Paulotto | H01Q 9/0414 |
| 2019/0166686 | A1* | 5/2019 | Jo | H01Q 1/523 |
| 2019/0319364 | A1* | 10/2019 | Yang | H01Q 5/385 |
| 2020/0021019 | A1 | 1/2020 | Rajagopalan et al. | |
| 2020/0106183 | A1* | 4/2020 | Fabrega Sanchez | H01Q 21/065 |
| 2020/0106192 | A1 | 4/2020 | Avser et al. | |
| 2021/0151860 | A1* | 5/2021 | Park | H01Q 9/0414 |
| 2021/0367358 | A1* | 11/2021 | He | H01Q 25/00 |

OTHER PUBLICATIONS

Corman, David; Anokiwave; "A Comprehensive Guide to Active Antennas (Or, "Beamforming 101")"; RF Globalnet; Jul. 9, 2018.

Sharma, Vijay; "A Novel Design of Parasitically Gap Coupled Patches Forming an Elliptical Patch Antenna for Broadband Performance"; Hindawi Publishing Corporation; Chinese Journal of Engineering; vol. 2014, Article ID 365048; Jul. 1, 2014.

Ta, Son Xuat; KEDZE, Kam Eucharist; CHIEN, Dao Ngoc; PARK, Ikmo; "Bandwidth-Enhanced Low-Profile Antenna with Parasitic Patches"; Hindawi; International Journal of Antennas and Propagation; vol. 2017, Article ID 6529060; Dec. 6, 2017.

Veerendra, K.; Ratna, G. Padma; Bhavanam, S. Nagakishore; "Design of Microstrip Patch Antenna with Parasitic Elements for Wideband Applications"; University College of Engineering & Technology Acharya Nagarjuna University, India; IJIRT, vol. 6, Issue 2, Jul. 2019.

Amritesh; Singh, Kshetrimayum Milan; "Design of Square Patch Microstrip Antenna for Circular Polarization USGIN IE3D Software"; Electronics and Communication Engineering National Institute of Technology; May 2009.

Abdelgwad, Ahmad H.; "Microstrip Patch Antenna Enhancement Techniques"; World Academy of Science, Engineering Technology, International Journal of Electronics and Communication Engineering; vol. 12; 2018.

* cited by examiner

DUAL-BAND CROSS-POLARIZED 5G MM-WAVE PHASED ARRAY ANTENNA

CROSS-REFERENCE TO RELATED APPLICATIONS

This application relates to and claims the benefit of U.S. Provisional Application No. 63/028,788, filed May 22, 2020 and entitled "DUAL-BAND CROSS-POLARIZED 5G MM-WAVE PHASED ARRAY ANTENNA," the disclosure of which is wholly incorporated by reference in its entirety herein.

STATEMENT RE: FEDERALLY SPONSORED RESEARCH/DEVELOPMENT

Not Applicable

BACKGROUND

1. Technical Field

The present disclosure relates generally to radio frequency (RF) communication devices and, more particularly, to a dual-band and cross-polarized 5G millimeter wave phased array antenna for active beamformer applications.

2. Related Art

Wireless communication systems find applications in numerous contexts involving information transfer over long and short distances alike, and a wide range of modalities tailored for each need have been developed. Chief among these systems with respect to popularity and deployment is the mobile or cellular phone. Generally, wireless communications utilize a radio frequency carrier signal that is modulated to represent data, and the modulation, transmission, receipt, and demodulation of the signal conform to a set of standards for coordination of the same. Many different mobile communication technologies or air interfaces exist, including GSM (Global System for Mobile Communications), EDGE (Enhanced Data rates for GSM Evolution), and UMTS (Universal Mobile Telecommunications System).

Various generations of these technologies exist and are deployed in phases, the latest being the 5G broadband cellular network system. 5G is characterized by significant improvements in data transfer speeds resulting from greater bandwidth that is possible because of higher operating frequencies compared to 4G and earlier standards. The air interfaces for 5G networks comprise two frequency bands, frequency range 1 (FR1), the operating frequency of which being below 6 GHz with a maximum channel bandwidth of 100 MHz, and frequency range 2 (FR2), the operating frequency of which being above 24 GHz with a channel bandwidth between 50 MHz and 400 MHz. The latter is commonly referred to as millimeter wave (mmWave) frequency range. Although the higher operating frequency bands, and mmWave/FR2 in particular, offer the highest data transfer speeds, the transmission distance of such signals may be limited. Furthermore, signals at this frequency range may be unable to penetrate solid obstacles. To overcome these limitations while accommodating more connected devices, various improvements in cell site and mobile device architectures have been developed.

One such improvement is the use of multiple antennas at both the transmission and reception ends, also referred to as MIMO (multiple input, multiple output), which is understood to increase capacity density and throughput. A series of antennas may be arranged in a single or multi-dimensional array, and further, may be employed for beamforming where radio frequency signals are shaped to point in a specified direction of the receiving device. A transmitter circuit feeds the signal to each of the antennas with the phase of the signal as radiated from each of the antennas being varied over the span of the array. The collective signal to the individual antennas may have a narrower beam width, and the direction of the transmitted beam may be adjusted based upon the constructive and destructive interferences from each antenna resulting from the phase shifts. Beamforming may be used in both transmission and reception, and the spatial reception sensitivity may likewise be adjusted.

There is an increasing demand for active beamforming technologies for use in current 5G communication devices such as cellular phones communicating over small-cell networks. To this end, array antenna packages may be used in 5G wireless communication devices for analog, digital, and hybrid beamforming applications. However, it is difficult to design a dual-band and cross-polarized array antenna to cover the full 5G millimeter wave operating bands, which include 26G (covering 24.25-27.5 GHz), 28G (covering 26.5-29.5 GHz), and 38G (covering 37-40 GHz). Therefore, in most cases, only a single band array antenna, either low band or high band, is used. For example, in the United States, a low band array antenna may be configured to radiate signals in the 27.5-28.3 GHz frequency band and a high band array antenna may be configured to radiate signals in the 37-40 GHz frequency band. In order to be used globally (since different countries use different bands), an array antenna would need to cover both of these bands as well as the remainder of the 28G band and the 26G band.

BRIEF SUMMARY

The present disclosure contemplates various devices for overcoming the above drawbacks associated with the related art. One aspect of the embodiments of the present disclosure is a dual-band cross-polarized antenna. The dual-band cross-polarized antenna may comprise a first metal layer at a first distance from a radio frequency (RF) ground plane, the first metal layer defining a first driven patch configured to radiate at a first frequency, and a second metal layer at a second distance from the RF ground plane, the second metal layer defining a second driven patch configured to radiate at a second frequency greater than the first frequency. The dual-band cross-polarized antenna may further comprise a first feed pin connecting a first feed line to the first driven patch at a first feed point thereof associated with a first polarization of the first patch, a second feed pin connecting the first feed line to the first driven patch at a second feed point thereof associated with a second polarization of the first patch orthogonal to the first polarization, a third feed pin connecting a second feed line to the second driven patch at a first feed point thereof associated with a first polarization of the second patch, and a fourth feed pin connecting the second feed line to the second driven patch at a second feed point thereof associated with a second polarization of the second patch orthogonal to the first polarization. The third feed pin may extend through a first hole in the first driven patch to capacitively couple the third feed pin to the first driven patch, and the fourth feed pin may extend through a second hole in the first driven patch to capacitively couple the fourth feed pin to the first driven patch.

The first and second feed points of the first driven patch may be equidistant from a center of the first driven patch, and the first and second feed points of the second driven patch may be equidistant from a center of the second driven patch.

The dual-band cross-polarized antenna may comprise a third metal layer at a third distance from the RF ground plane, the third metal layer defining a shared parasitic patch configured to radiate according to a current induced by inductive and capacitive coupling between the shared parasitic patch and the first and second driven patches. The first driven patch, the second driven patch, and the shared parasitic patch may be square. The first driven patch may have a length of 2.5 mm to 3.0 mm, the second driven patch may have a length of 1.5 mm to 2.0 mm, and the shared parasitic patch may have a length of 1.5 mm to 2.0 mm.

The first metal layer may further define one or more first parasitic patches configured to radiate according to a current induced by inductive and capacitive coupling between the one or more second parasitic patches and the first driven patch. The first driven patch may be square, and the one or more first parasitic patches may comprise four first parasitic patches respectively arranged adjacent to the four sides of the first driven patch.

The second metal layer may further define one or more second parasitic patches configured to radiate according to a current induced by inductive and capacitive coupling between the one or more second parasitic patches and the second driven patch. The second driven patch may be square, and the one or more second parasitic patches may comprise four second parasitic patches respectively arranged adjacent to the four sides of the second driven patch.

The dual-band cross-polarized antenna may comprise a first catch pad, disposed in the first hole, through which the third feed pin extends and a second catch pad, disposed in the second hole, through which the fourth feed pin extends. A diameter of the first catch pad, a diameter of the first hole, a diameter of the second catch pad, and a diameter of the second hole may be tuned to achieve an input return loss at the second frequency of less than −10 dB.

The dual-band cross-polarized antenna may further comprise a ground feed pin connecting the RF ground plane to the first driven patch and the second driven patch.

The first and second feed lines may be formed in one or more metal layers of a multi-layer printed circuit board (PCB) comprising the RF ground plane. The first, second, third, and fourth feed pins may extend through respective holes in the RF ground plane. The dual-band cross-polarized antenna may further comprise an RF front end integrated circuit disposed on an opposite side of the multi-layer PCB from the first and second metal layers, one or more signal output pins of the RF front end integrated circuit being connected to the first and second feed lines.

Another aspect of the embodiments of the present disclosure is an antenna module. The antenna module may comprise a multi-layer printed circuit board (PCB) including a radio frequency (RF) ground plane. The antenna module may further comprise a first metal layer at a first distance from the RF ground plane, the first metal layer defining a first driven patch configured to radiate at a first frequency, and a second metal layer at a second distance from the RF ground plane, the second metal layer defining a second driven patch configured to radiate at a second frequency greater than the first frequency. The antenna module may comprise a first feed pin connecting a first feed line to the first driven patch at a first feed point thereof associated with a first polarization of the first driven patch, a second feed pin connecting the first feed line to the first driven patch at a second feed point thereof associated with a second polarization of the first driven patch orthogonal to the first polarization, a third feed pin connecting a second feed line to the second driven patch at a first feed point thereof associated with a first polarization of the second driven patch, and a fourth feed pin connecting the second feed line to the second driven patch at a second feed point thereof associated with a second polarization of the second driven patch orthogonal to the first polarization. The first feed line and the second feed line may be formed in one or more metal layers of the multi-layer PCB. The third feed pin may extend through a first hole in the first driven patch to capacitively couple the third feed pin to the first driven patch, and the fourth feed pin may extend through a second hole in the first driven patch to capacitively couple the fourth feed pin to the first driven patch. The antenna module may further comprise an RF front end integrated circuit disposed on an opposite side of the multi-layer PCB from the first and second metal layers, one or more signal output pins of the RF front end integrated circuit being connected to the first and second feed lines. The antenna module may further comprise a package containing the first and second metal layers, the first, second, third, and fourth feed pins, and the multi-layer PCB including the RF ground plane and the one or more metal layers forming the first and second feed lines. The RF front end integrated circuit may be mounted on the package, and an outer surface of the package may have conductive contacts for routing input signals through the multi-layer PCB to one or more signal input pins of the RF front end integrated circuit.

Another aspect of the embodiments of the present disclosure is a dual-band cross-polarized phased array antenna. The dual-band cross-polarized phased array antenna may comprise two or more antenna elements arranged in an array. Each of the antenna elements may comprise a first driven patch configured to radiate at a first frequency, the first driven patch defined in a first metal layer at a first distance from a radio frequency (RF) ground plane, and a second driven patch configured to radiate at a second frequency greater than the first frequency, the second driven patch defined in a second metal layer at a second distance from the RF ground plane. Each of the antenna elements may further comprise a first feed pin connecting a first feed line to the first driven patch at a first feed point thereof associated with a first polarization of the first patch, a second feed pin connecting the first feed line to the first driven patch at a second feed point thereof associated with a second polarization of the first patch orthogonal to the first polarization, a third feed pin connecting a second feed line to the second driven patch at a first feed point thereof associated with a first polarization of the second patch, and a fourth feed pin connecting the second feed line to the second driven patch at a second feed point thereof associated with a second polarization of the second patch orthogonal to the first polarization. In each of the antenna elements, the third feed pin may extend through a first hole in the first driven patch to capacitively couple the third feed pin to the first driven patch, and the fourth feed pin may extend through a second hole in the first driven patch to capacitively couple the fourth feed pin to the first driven patch.

A distance $D_A$ between centers of the antenna elements may be between 0.3 and 0.4 times a free space wavelength $\lambda_0$ of the first frequency.

The two or more antenna elements may be arranged in a two-by-two array.

The two or more antenna elements may be arranged in a four-by-one array.

The dual-band cross-polarized phased array antenna may comprise a multi-layer printed circuit board (PCB) including the RF ground plane and one or more metal layers forming the first and second feed lines and may further comprise an RF front end integrated circuit disposed on an opposite side of the multi-layer PCB from the two or more antenna elements. One or more signal output pins of the RF front end integrated circuit may be connected to the first and second feed lines. The dual-band cross-polarized phased array antenna may comprise a package containing the two or more antenna elements and the multi-layer PCB. The RF front end integrated circuit may be mounted on the package. An outer surface of the package may have conductive contacts for routing input signals through the multi-layer PCB to one or more signal input pins of the RF front end integrated circuit.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of dual-band cross-polarized antennas, including phased array antennas, for 5G millimeter wave applications. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
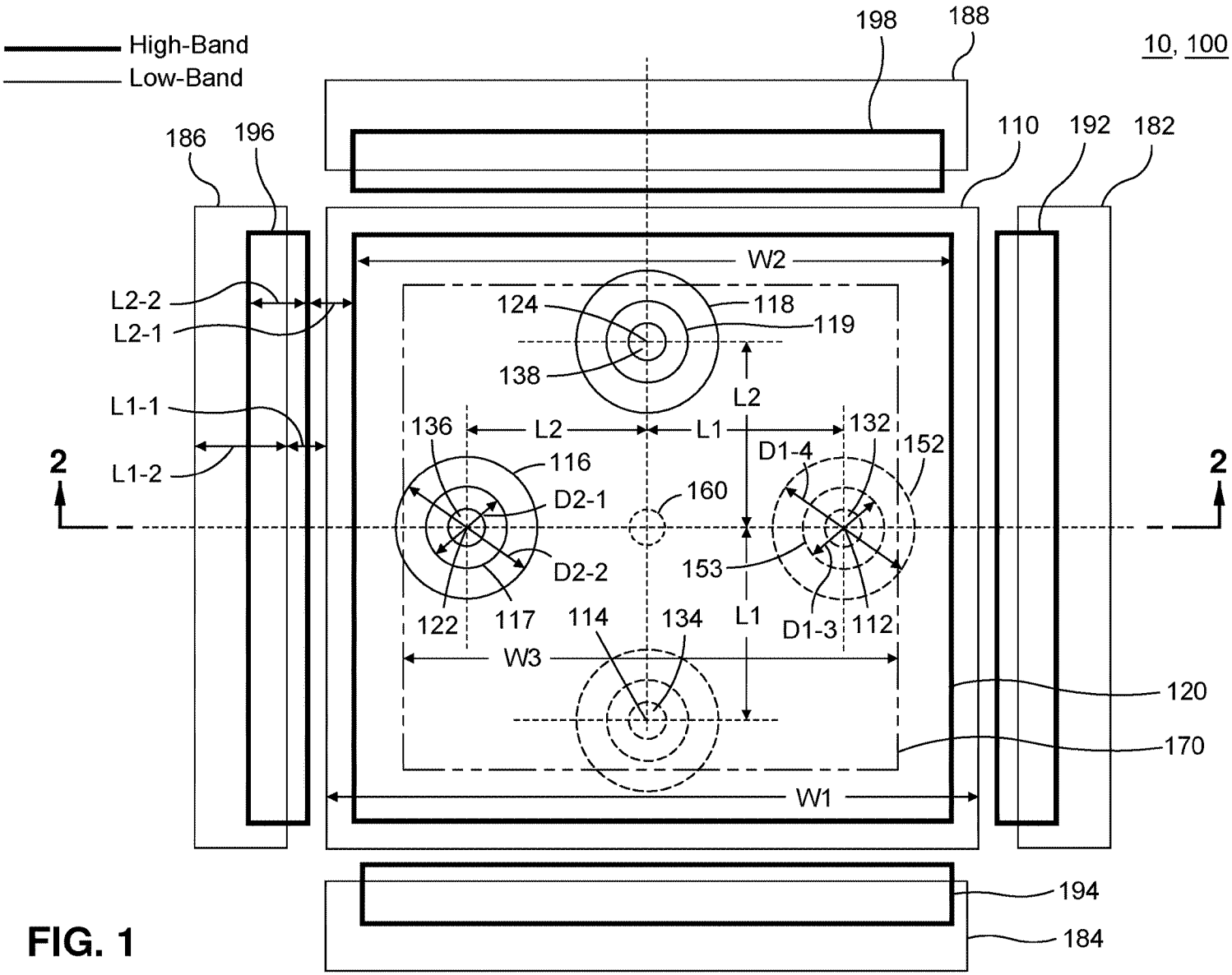
FIG. 1 is a plan view of a dual-band cross-polarized antenna according to an embodiment of the present disclosure.
Figure 2:
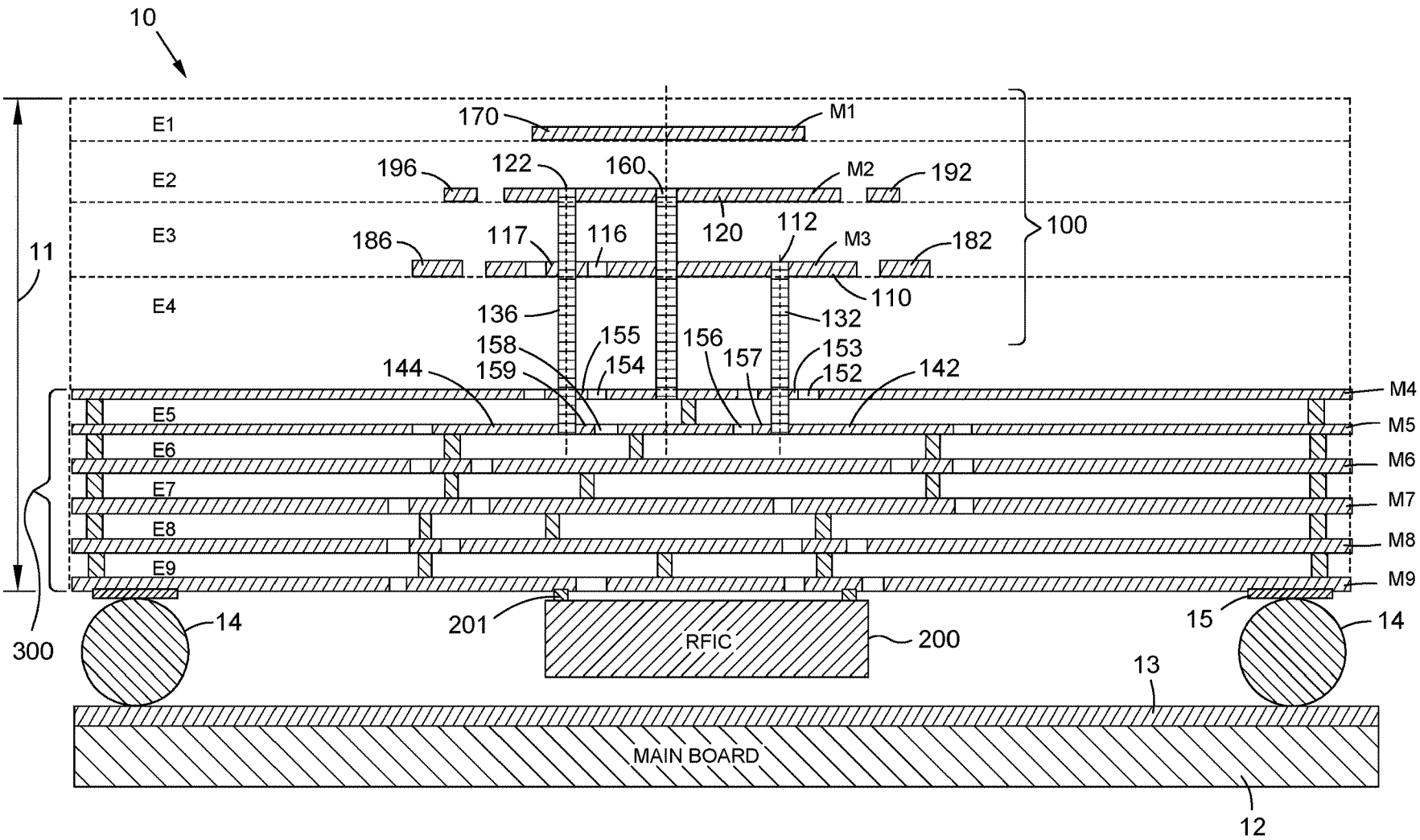
FIG. 2 is a cross-sectional view taken along the line 2-2 in FIG. 1 showing an antenna module comprising the dual-band cross-polarized antenna.
Figure 3:
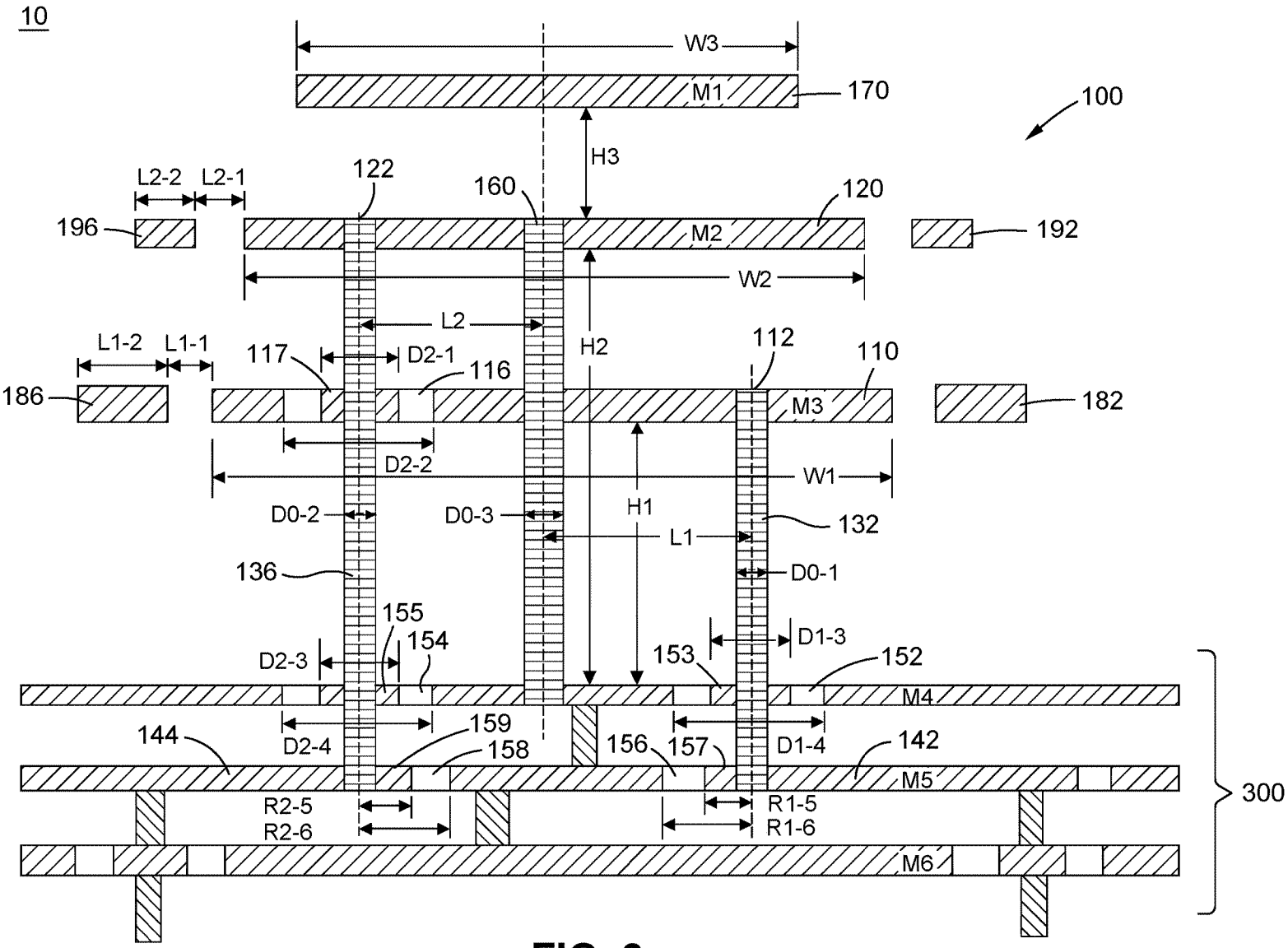
FIG. 3 is a close-up view of FIG. 2.

FIG. 1 is a plan view of a dual-band cross-polarized antenna 10 according to an embodiment of the present disclosure. FIG. 2 is a cross-sectional view taken along the line 2-2 in FIG. 1, and FIG. 3 is a close-up view thereof. The disclosed dual-band cross-polarized antenna 10, and in particular a phased array antenna comprising the same, may significantly reduce the development time and cost of wireless communication modules while increasing performance. As shown, the antenna 10 may be fabricated according to Antenna-in-Package (AiP) technology in which one or more antenna elements 100 are packaged together with or in close proximity to an RF front end integrated circuit (RFIC) 200 including RF front end circuitry for transmitting and receiving signals using the antenna element(s) 100. Routing to and from the RFIC 200, including feed lines and RF ground for the antenna element(s) 100, may be provided in a multi-layer printed circuit board (PCB) 300 included in the same package 11. The entire antenna 10, which may also be referred to as an antenna module (or antenna chip), may then be connected to a main circuit board 12 (e.g. a main PCB of a smartphone or other mobile device), which may have a larger dimension than the antenna module. For example, soldering pins or ball grid array (BGA) bumps or balls 14 may be provided on the antenna module (e.g. on the outside of the package 11) for connection to a top metal layer 13 of the main circuit board 12.

In order to provide capability in two orthogonal polarizations (e.g. horizontal and vertical) while also covering multiple 5G millimeter wave operating bands, each antenna element 100 may include first and second driven patches 110, 120 and first, second, third, and fourth feed pins 132, 134, 136, 138 for radiating vertical and horizontal polarized signals in either transmitting or receiving mode. For example, as shown in FIG. 2 and FIG. 3, the antenna 10 may include a first metal layer M3 at a first distance H1 from an RF ground plane M4, the first metal layer M3 defining a first driven patch 110 (sometimes referred to as a radiating patch) configured to radiate at a first frequency. The antenna 10 may further include a second metal layer M2 at a second distance H2 from the RF ground plane M4, the second metal layer M2 defining a second driven patch 120 configured to radiate at a second frequency greater than the first frequency. Through the use of both the first and second frequencies, transmit and receive functions can be realized at the same time for full duplex functionality. So as to cover the full spectrum of 5G millimeter wave bands, the first frequency may be a low-band frequency within the range of 24.25-29.5 GHz and the second frequency may be a high-band frequency within the range of 37-43.5 GHz, for example. As shown in FIG. 1, the first driven patch 110 may be fed at two feed points 112, 114 that are associated with orthogonal polarizations of the first driven patch 110, and the second driven patch 120 may likewise be fed at two feed points 122, 124 that are associated with orthogonal polarizations of the second driven patch 120. For example, orthogonal linear polarizations (e.g. horizontal and vertical) may be produced by feeding each driven patch 110, 120 at orthogonal regions (i.e. 90 degrees apart) relative to the center of the driven patch 110, 120.

More specifically, feeding the RF signal to the first driven patch 110 at the first feed point 112 thereof may produce a current in the first driven patch 110 that causes the first driven patch 110 to radiate with a horizontal polarization, whereas feeding at the second feed point 114 may produce a current in the first driven patch 110 that causes the first driven patch 110 to radiate with a vertical polarization. Likewise, feeding the RF signal to the second driven patch 120 at the first feed point 122 thereof may produce a current in the second driven patch 120 that causes the second driven patch 120 to radiate with a horizontal polarization, whereas feeding at the second feed point 124 may produce a current in the second driven patch 120 that causes the second driven patch 120 to radiate with a vertical polarization. To achieve the same performance for horizontal and vertical polarizations, the antenna element 100 may have a symmetrical or quasi-symmetrical structure. To this end, the first and second feed points 112, 114 of the first driven patch 110 may be equidistant from the center of the first driven patch 110, and the first and second feed points 122, 124 of the second driven patch 120 may be equidistant from the center of the second driven patch 120. Similarity of performance may be possible by making the first and second driven patches 110, 120 square as shown in FIG. 1. The first and second feed points 112, 114 of the first driven patch 110 may be centrally formed along adjacent edges of the first driven patch 110. The first and second feed points 122, 124 of the second driven patch 120 may likewise be centrally formed along adjacent edges of the second driven patch 120, opposite those edges of the first driven patch 110. The exact positions of the first and second feed points 112, 114, 122, 124 may be determined to match an input impedance of each driven patch 110, 120, for example.

Referring again to FIG. 2 and FIG. 3, the first and third feed pins 132, 136 are visible in cross-section, terminating at the first feed point 112 of the first driven patch 110 and the first feed point 122 of the second driven patch 120, respectively. As shown, the first feed pin 132 may connect a first feed line 142 to the first driven patch 110 at the first feed point 112 thereof, and the third feed pin 136 may connect a second feed line 144 to the second driven patch 120 at the first feed point 122 thereof. The first and second feed lines 142, 144 may be formed in one or more metal layers of a multi-layer printed circuit board (PCB) 300 that further includes the RF ground plane M4. In the illustrated embodiment, for example, the first and second feed lines 142, 144 are formed in the same metal layer, namely the metal layer M5, and are formed as a stripline structure grounded by the RF ground plane M4 as well as ground plane on layer M6. Between the second feed line 144 and the second driven patch 120, the third feed pin 136 may extend through a first hole 116 in the first driven patch 110 to capacitively couple the third feed pin 136 to the first driven patch 110. In this way, part of the high-band energy may radiate via the low-band patch 110 as well. More specifically, a first catch pad 117 may be provided in the first hole 116 as shown, and the third feed pin 136 may extend through the first catch pad 117. The diameter D2-1 of the first catch pad 117 and the diameter D2-2 of the first hole 116 may be tuned to achieve a desired input return loss at the second frequency, preferably less than −10 dB, for example. The diameters D2-1, D2-2 may have a strong influence on high band return loss and bandwidth.

FIG. 2 and FIG. 3 are provided as cross-sectional views taken along the horizontal line 2-2 passing through the centers of the driven patches 110, 120 in FIG. 1, thus providing a view of the first and third feed pins 132, 136. In a symmetrically structured antenna element 100, these same views may serve as cross-sectional views taken along the vertical line passing through the centers of the driven patches 110, 120, perpendicular to the horizontal line 2-2 (and facing to the right in FIG. 1). In this regard, it may be understood that the illustration of the first and third feed pins 132, 136 of FIG. 2 and FIG. 3 may likewise serve as an illustration of the second and fourth feed pins 134, 138, respectively. In particular, the second feed pin 134 may connect the first feed line 142 to the first driven patch 110 at the second feed point 114 thereof (just as the first feed pin 132 connects the first feed line 142 to the first driven patch 110 at the first feed point 112 in FIG. 2 and FIG. 3), and the fourth feed pin 138 may connect the second feed line 144 to the second driven patch 120 at the second feed point 124 thereof (just as the third feed pin 136 connects the second feed line 144 to the second driven patch 120 at the first feed point 122 in FIG. 2 and FIG. 3). Between the second feed line 144 and the second driven patch 120, the fourth feed pin 138 may extend through a second hole 118 in the first driven patch 110 (see FIG. 1) to capacitively couple the fourth feed pin 138 to the first driven patch 110. Equivalently to the first catch pad 117 shown in FIG. 2 and FIG. 3, a second catch pad 119 may be provided in the second hole 118, and the fourth feed pin 138 may extend through the second catch pad 119. The diameters of the second catch pad 119 and second hole 118 may similarly be tuned to achieve a desired input return loss at the second frequency, preferably less than −10 dB, for example.

As explained above, the first and second feed lines 142, 144 may be formed in a metal layer M5 of a stripline structure comprising the RF ground plane M4, which may be part of a multi-layer PCB 300. More specifically, the metal layer M5 defining the feed trace network for the antenna element 100 may be sandwiched between the RF ground plane M4 and another metal layer M6, which together may serve as ground planes for the feed lines 142, 144. The RFIC 200 may be located below the metal layer M6. As shown in FIG. 2, for example, the RFIC 200 may be located below the stripline structure defined by the metal layers M4-M6 and further below a second stripline structure comprising a metal layer M7 electrically connected to the metal layer M5 (e.g. by vias), which is sandwiched between metal layers M6 and M8 serving as ground planes. These metal layers M6 and M8, as well as a lowermost metal layer M9 of the multi-layer PCB 300, may be used for routing to and from the RFIC 200. For example, RF signals from the RFIC 200 may go to the metal layer M5 feed trace through feed via(s) on metal layer M6. The feed traces in metal layer M5 may then excite the patch feed pins 132, 134, 136, 138, which connect to the driven patches 110, 120 through holes in the RF ground plane M4.

As noted above, the one or more antenna elements 100 may be packaged with the multi-layer PCB 300 together with or in close proximity to the RFIC 200. In the example illustrated in FIG. 2, the antenna 10 comprises a package 11 that contains the antenna element 100 and PCB 300, with the RFIC 200 disposed underneath and connected to the package 11. The package 11 may be made of plastic or ceramic, for example, and may contain a plurality of metal layers M1-M9 separated by an equal number of dielectric layers E1-E9, collectively comprising the antenna element 100 and multi-layer PCB 300. An outer surface of the package 11 may have conductive contacts such as micro-bumps 201 for connection of the RFIC 200 to the multi-layer PCB 300. The micro-bumps 201 may electrically connect input and output pins of the RFIC 200 to the lowermost metal layer M9 of the multi-layer PCB 300 within the package 11, with the RFIC 200 being disposed underneath the package 11 as shown (i.e. between the package 11 and the main circuit board 12 of the mobile phone or other device in which the packaged antenna is installed). The outer surface of the package 11 may also have conductive contacts such as soldering pads 15 and BGA balls 14 for routing input signals and other inputs from the main circuit board 12 through the multi-layer PCB 300 to one or more signal input pins, grounding pins, or DC and digital control pins of the RFIC 200 (via the micro-bumps 201). These inputs may be routed through the lowermost metal layer M9 of the multi-layer PCB 300, for example.

The RFIC 200 may be mounted on the underside of the package 11, and positioned such that it is between the package 11 and the top metal layer 13 of the main circuit board 12. The antenna module may refer to the combination of the RFIC 200 and the package 11 containing the one or more antenna elements 100 and multi-layer PCB 300.

To electrically connect the first and second feed lines 142, 144 to the driven patches 110, 120, the first, second, third, and fourth feed pins 132, 134, 136, 138 may extend through the RF ground plane M4, e.g. through respective holes provided therein. For example, as shown in FIG. 2 and FIG. 3, between the first feed line 142 and the first driven patch 110, the first feed pin 132 may extend through a hole 152 in the RF ground plane M4 having a diameter D1-4. Similarly, between the second feed line 144 and the first driven patch 110, the third feed pin 136 may extend through a hole 154 in the RF ground plane M4 having a diameter D2-4. Catch pads 153, 155 may be provided respectively in the first and second holes 152, 154 as shown, with the first and third feed pins 132, 136 extending through the respective catch pads 153, 155. The connection of the first, second, third, and fourth feed pins 132, 134, 136, 138 to the first and second feed lines 142, 144 may be via respective catch pads provided in holes formed in the metal layer M5 as shown. For example, as can be seen in FIG. 2 and FIG. 3, the first feed pin 132 may connect to the first feed line 142 at a catch pad 157 that is provided in a hole 156 defined by the metal layer M5, and the third feed pin 136 may connect to the second feed line 143 at a catch pad 159 that is provided in a hole 158 defined by the metal layer M5. The catch pad and catch-hole diameters D1-3, D1-4 of the catch pad 153 and hole 152, as well as the catch pad and catch-hole radii R1-5, R1-6 of the catch pad 157 and hole 156, may be tuned to achieve a desired input return loss at the first (low-band) frequency, preferably less than −10 dB. Likewise, in addition to the tuning of the diameter D2-1 of the first catch pad 117 and the diameter D2-2 of the first hole 116 described above, the catch pad and catch-hole diameters D2-3, D2-4 of the catch pad 155 and hole 154, as well as the catch pad and catch-hole radii R2-5, R2-6 of the catch pad 159 and hole 158, may be tuned to achieve the desired input return loss at the second (high-band) frequency, preferably less than −10 dB. Corresponding catch pads and holes may be formed in the metal layers M4 and M5 in relation to the vertical polarization feed pins 134, 138 (not pictured but equivalently illustrated in FIG. 2 and FIG. 3 as described above), with the diameters and radii of such elements being similarly tuned to achieve desired input return loss at the first and second frequencies.

In order to improve cross-polarization between feeds in the same frequency band, for example, between the first and second feed pins 132, 134 of the first driven patch 110 (or between the third and fourth feed pins 136, 138 of the second driven patch 120), as well as to improve isolation between feeds in different bands, a ground feed pin 160 may be used to connect the RF ground plane M4 to the first and second driven patches 110, 120. As shown in FIGS. 1-3, the ground feed pin 160 may extend from the RF ground plane M4, through the first driven patch 110, to the second driven patch 120, electrically connecting the RF ground plane M4, the first driven patch 110, and the second driven patch 120. The ground feed pin 160 may pass through the center of the first driven patch 110 and terminate at the center of the second driven patch 120. The feed diameters of the low band feed pins (first and third feed pins 132, 136), the high band feed pins (second and fourth feed pins 134, 138), and the ground feed pin 160 may differ.

In order to achieve wideband operation, the antenna 10 may further include a third metal layer M1 at a third distance from the RF ground plane M4 (which may be defined in relation to a distance H3 from the second metal layer M2 as shown in FIG. 3). The third metal layer M1 may define a shared parasitic patch 170 that is configured to radiate according to a current induced by inductive coupling, namely between the shared parasitic patch 170 and the first and second driven patches 110, 120. In this way, the shared parasitic patch 170 may radiate in response to the driving of both the first and second driven patches 110, 120, thereby increasing the bandwidth of the antenna 10 in both frequency bands. In the case of square first and second driven patches 110, 120, the shared parasitic patch 170 may likewise be square. The shared parasitic patch 170 may be smaller than the second driven patch 120, which may be smaller than the first driven patch 110. In general, the first frequency may be chosen by tuning the length W1 (e.g. length on a side) and width (may also be W1 in the case of a square) of the first driven patch 110 as well as its distance H1 from the RF ground plane M4 so that the first driven patch 110 radiates at the desired low-band frequency. Similarly, the second frequency may be chosen by tuning the length W2 and width (may also be W2 in the case of a square) of the second driven patch 120 as well as its distance H2 from the RF ground plane M4 so that the second driven patch 120 radiates at the desired high-band frequency. The length W3 and distance H3 (or distance from RF ground plane M4) of the shared parasitic patch 170 may be tuned to get optimal bandwidth in both bands. For example, the first driven patch 110 may have a length W1 of 2.5 mm to 3.0 mm for frequencies between 20-30 GHz, the second driven patch 120 may have a length W2 of 1.5 mm to 2.0 mm for frequencies between 35-45 GHz, and the shared parasitic patch 170 may have a length W3 of 1.5 mm to 2.0 mm for frequencies between 20-45 GHz. Each antenna element 100 of the antenna 10 may thus have a three-patch, three-layered structure comprising a bottom patch (the first driven patch 110), a middle patch (the second driven patch 120), and a top patch (the shared parasitic patch 170), with the bottom patch determining the low band, the middle patch determining the high band, and the top patch having influence on both the low band and the high band.

Additional parasitic patches may be provided for one or the other of the first and second driven patches 110, 120. For example, the first metal layer M3 may define one or more first parasitic patches 182, 184, 186, 188 (collectively, first parasitic patches 180) that are configured to radiate according to a current induced by inductive and capacitive coupling between the one or more first parasitic patches 180 and the first driven patch 110. As shown in FIG. 1, the one or more first parasitic patches 182, 184, 186, 188 may comprise four first parasitic patches 182, 184, 186, 188 respectively arranged adjacent to four sides of the first driven patch 110, e.g. adjacent to the four sides of a square patch. The parasitic patch distance L1-1 and width L1-2 of each first parasitic patch 180 (which may be the same in the case of a symmetrical arrangement) may be tuned to achieve wide operating bandwidth around the first wavelength. In the illustrated embodiment, the first parasitic patches 180 are rectangles whose long dimensions are aligned parallel with and have the same length as the sides of the first driven patch 110, though it is contemplated that the long dimensions may be longer or shorter than the adjacent sides of the first driven patch 110. Non-rectangular configuration of parasitic patches could be used as well.

By the same token, the second metal layer M2 may define one or more second parasitic patches 192, 194, 196, 198 (collectively, second parasitic patches 190) that are configured to radiate according to a current induced by inductive and capacitive coupling between the one or more second parasitic patches 190 and the second driven patch 120. The second parasitic patches 190 may likewise comprise four second parasitic patches 192, 194, 196, 198 respectively arranged adjacent to four sides of the second driven patch 120, e.g. adjacent to the four sides of a square patch. The parasitic patch distance L2-1 and width L2-2 of each second parasitic patch 190 (which may be the same in the case of a symmetrical arrangement) may be tuned to achieve wide operating bandwidth around the second wavelength. In a case where the second driven patch 120 is smaller than the first driven patch 110 as shown, the second parasitic patches 190 may be smaller than the first parasitic patches 180, e.g. patch width L2-2 being less than patch width L1-1. Similar to the first parasitic patches 180, the second parasitic patches 190 may be rectangles, with the long dimensions being aligned parallel with the sides of the second driven patch 120 in this case. As in the case of the first parasitic patches 180, it is also contemplated that the long dimensions may be longer or shorter than the corresponding sides of the second driven patch 120. Non-rectangular configuration of parasitic patches could be used as well.

Figure 4:
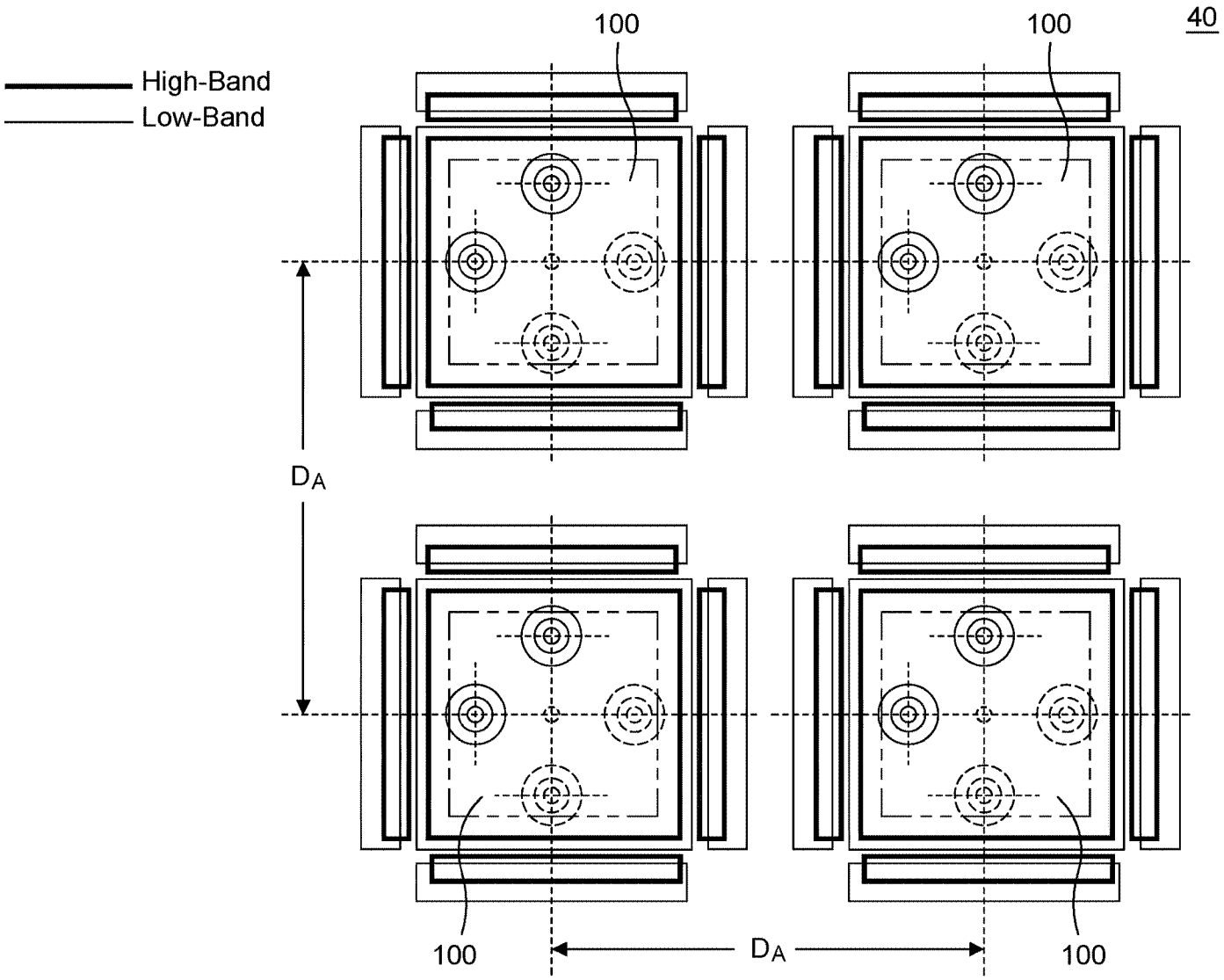
FIG. 4 is a plan view of an array antenna comprising a two-by-two array of the dual-band cross-polarized antenna.

FIG. 4 is a plan view of an array antenna 40 comprising a two-by-two array of the antenna element 100 described in relation to the dual-band cross-polarized antenna 10 of FIGS. 1-3. As noted above, the antenna 10 of FIGS. 1-3 may be fabricated according to AiP technology in which one or more antenna elements 100 are packaged together with or in close proximity to an RFIC 200, and a multi-layer PCB 300 may be included in the same package with the antenna element(s) 100. The array antenna 40 of FIG. 4 may represent one such packaging of antenna elements 100, which may share a single multi-layer PCB 300 within the same package 11 and a single RFIC 200 (e.g. underneath the package 11 as shown in FIG. 2). The distance $D_A$ between centers of the antenna elements 100 may be selected to produce a desired beamforming scanning angle for a phased array antenna, which may be controlled by the RFIC 200. For example, the distance $D_A$ between centers of the antenna elements 100 may be between 0.3 and 0.4 times a free space wavelength $\lambda_0$ of the first frequency (e.g. 0.3233 $\lambda_0$=4 mm for the low-band frequency of 24.25 GHz).

Figure 5:
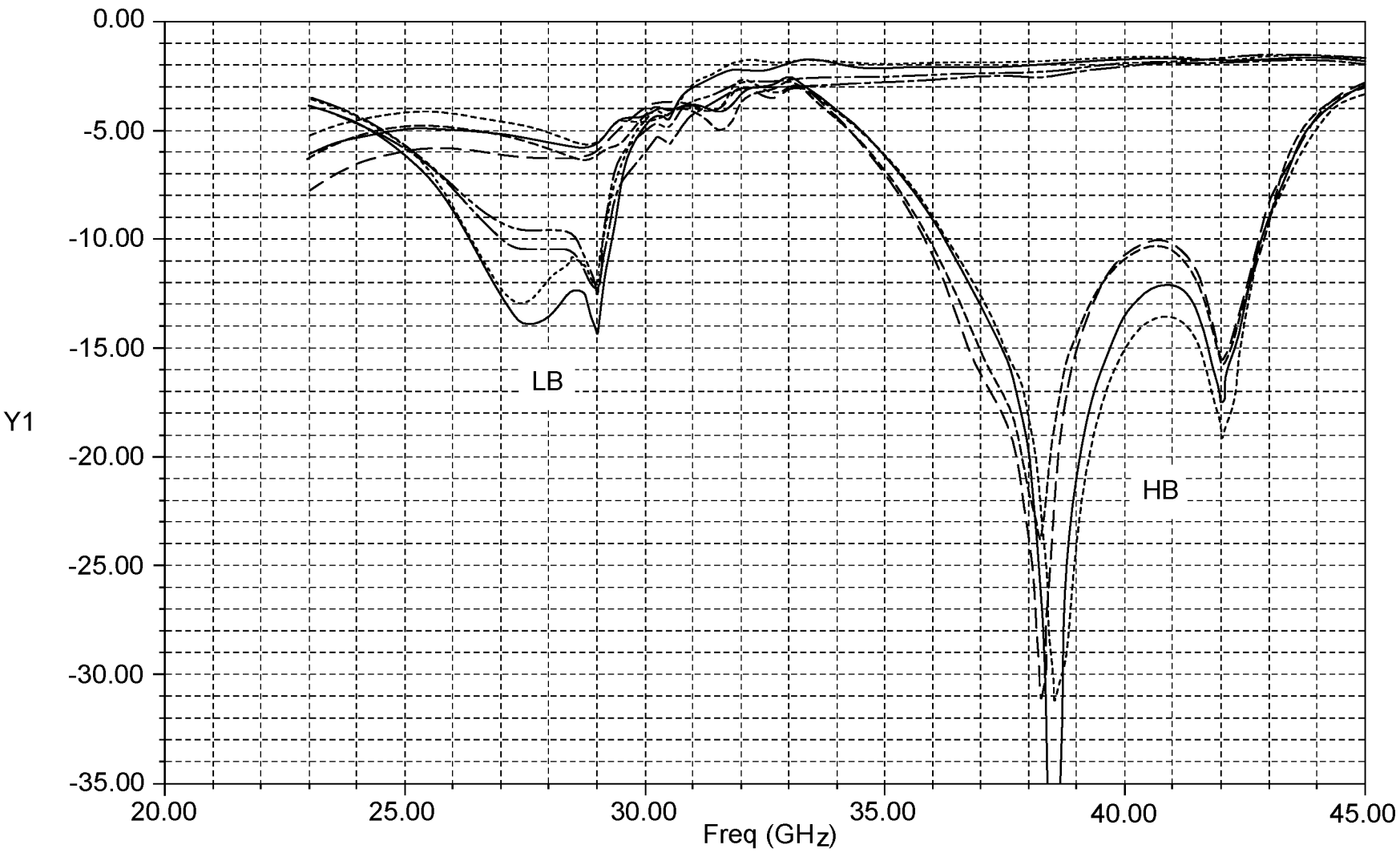
FIG. 5 is a graphical representation of input return loss of the two-by-two array.
Figure 6:
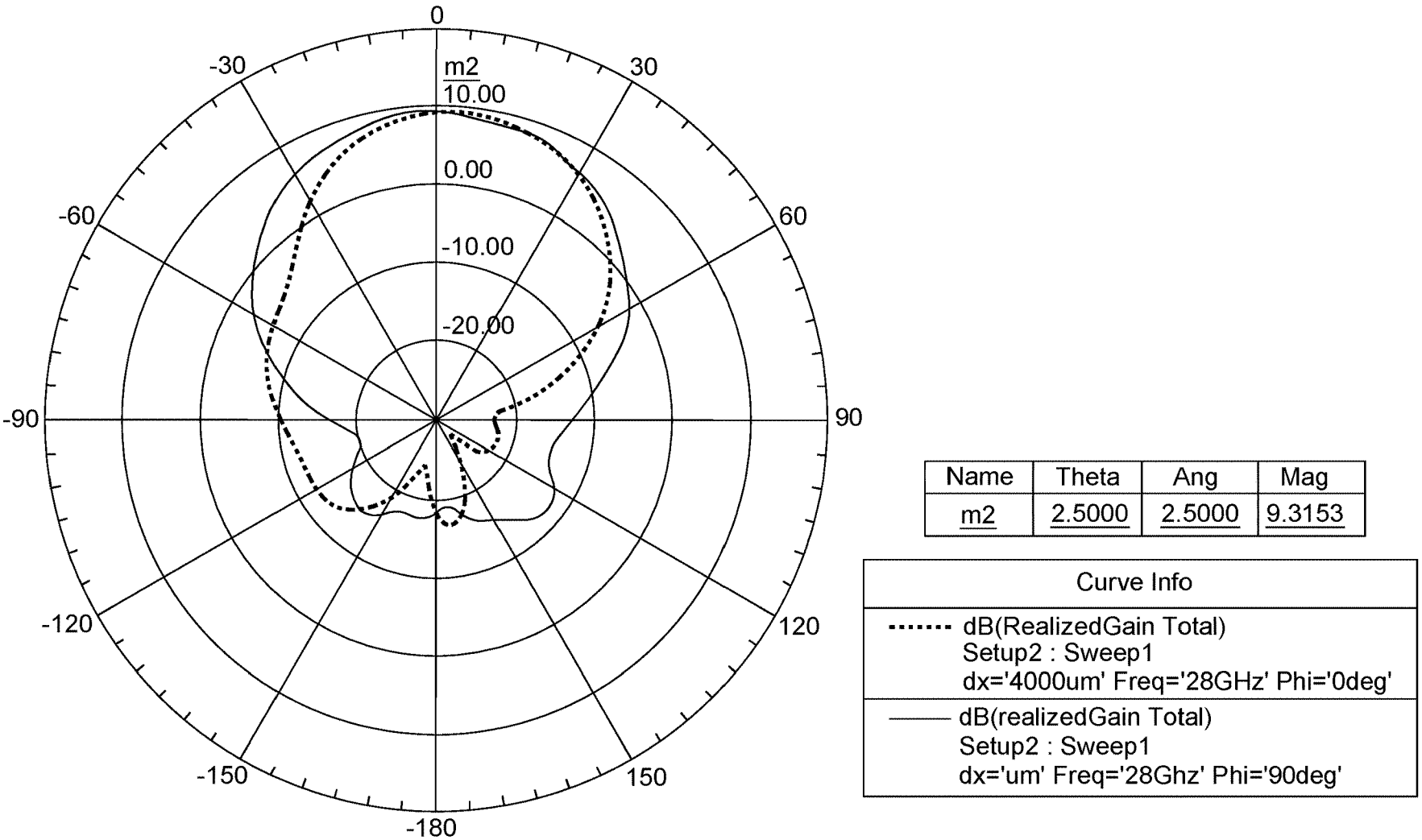
FIG. 6 is a graphical representation of a low-band radiation pattern of the two-by-two array.
Figure 7:
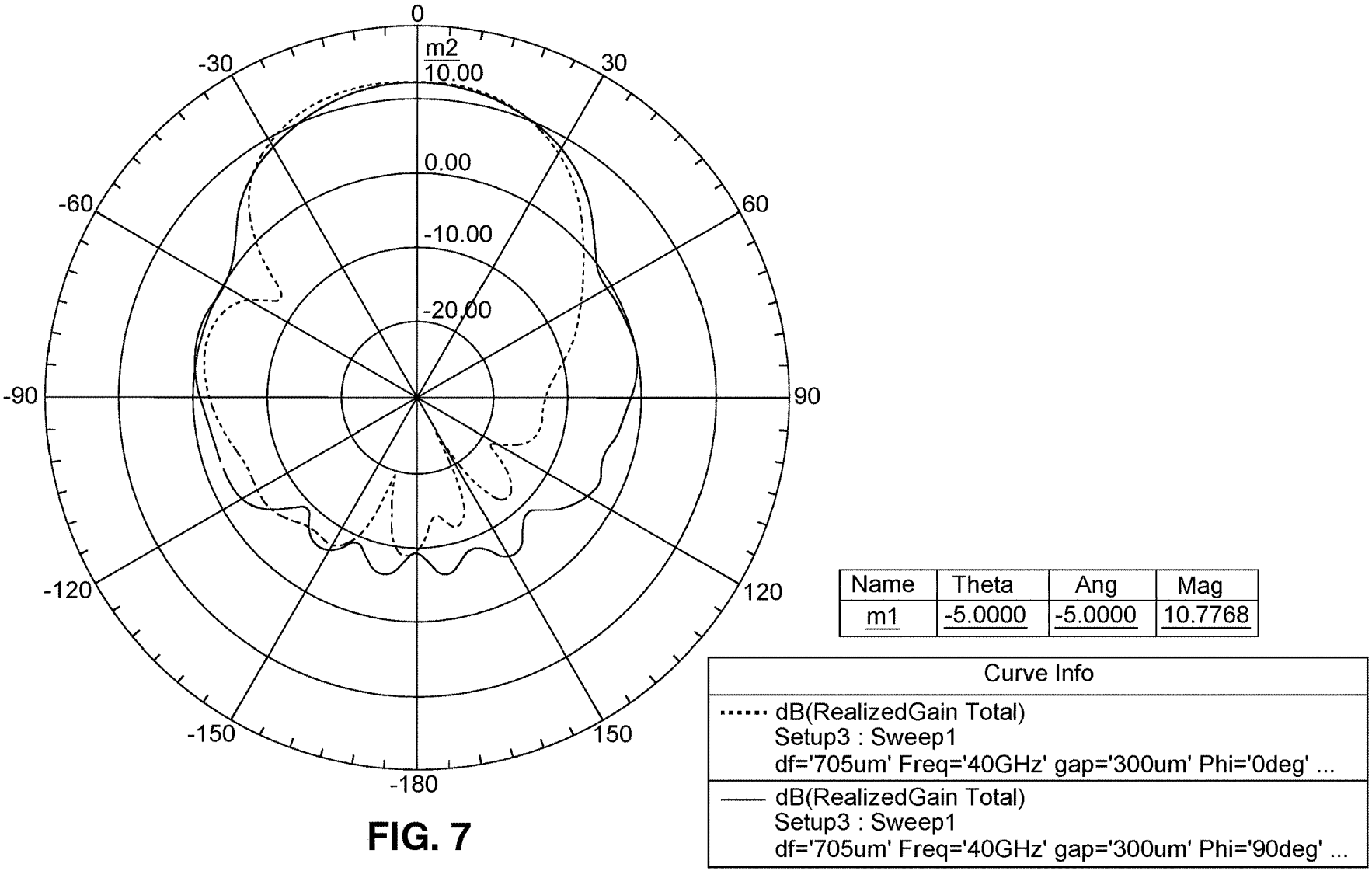
FIG. 7 is a graphical representation of a high-band radiation pattern of the two-by-two array.

FIG. 5 is a graphical representation of input return loss of the two-by-two array of antenna elements 100 shown in FIG. 4, with the distance $D_A$ between centers of the antenna elements 100 being 4 mm. FIG. 6 and FIG. 7 are graphical representations of radiation patterns of the same two-by-two array of antenna elements 100, with FIG. 6 being a low-band broadside sum pattern and FIG. 7 being a high-band broadside sum pattern. In the simulation, the feeds (ports) of all four antenna elements 100 are loaded by 50 ohms with only the vertical feed being excited in each band (i.e. the second and fourth feed pins 134, 138 as shown in FIGS. 1-3) for vertical polarization. As can be seen, maximum gain is expected to be +9.3 dBi at 28 GHz and +10.7 dBi at 40 GHz in the boresight (perpendicular) direction.

Figure 8:
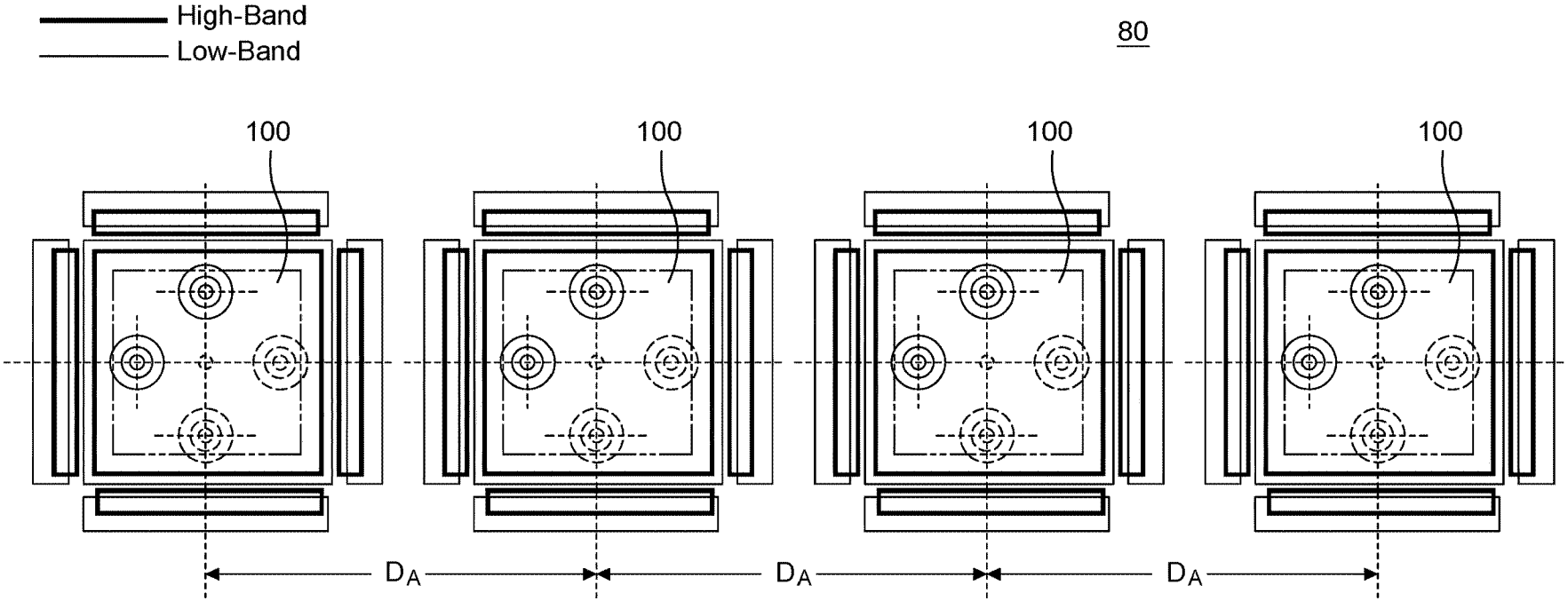
FIG. 8 is a plan view of another array antenna comprising a four-by-one array of the dual-band cross-polarized antenna.

FIG. 8 is a plan view of another array antenna 80 comprising a four-by-one array of the antenna element 100 described in relation to the dual-band cross-polarized antenna 10 of FIGS. 1-3. Like the array antenna 40 of FIG. 4, the array antenna 80 of FIG. 8 may represent one such AiP packaging of antenna elements 100 as described above, which may share a single multi-layer PCB 300 within the same package 11 and a single RFIC 200 (e.g. underneath the package 11 as shown in FIG. 2). The distance $D_A$ between centers of the antenna elements 100 may be selected to produce a desired beamforming scanning angle for a linear phased array antenna, which may be controlled by the RFIC 200. For example, the distance $D_A$ between centers of the antenna elements 100 may be between 0.3 and 0.4 times a free space wavelength $\pi_0$ of the first frequency (e.g. 0.3233 $\lambda_0$=4 mm for the low-band frequency of 24.25 GHz).

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A dual-band cross-polarized antenna comprising:

a first metal layer at a first distance from a radio frequency (RF) ground plane, the first metal layer defining a first driven patch configured to radiate at a first frequency;

a second metal layer at a second distance from the RF ground plane, the second metal layer defining a second driven patch configured to radiate at a second frequency greater than the first frequency;

a first feed pin connecting a first feed line to the first driven patch at a first feed point thereof associated with a first polarization of the first driven patch;

a second feed pin connecting the first feed line to the first driven patch at a second feed point thereof associated with a second polarization of the first driven patch orthogonal to the first polarization;

a third feed pin connecting a second feed line to the second driven patch at a first feed point thereof associated with a first polarization of the second driven patch, the third feed pin extending through a first hole in the first driven patch to capacitively couple the third feed pin to the first driven patch; and a fourth feed pin connecting the second feed line to the second driven patch at a second feed point associated with a second polarization of the second driven patch orthogonal to the first polarization, the fourth feed pin extending through a second hole in the first driven patch to capacitively couple the fourth feed pin to the first driven patch.

2. The dual-band cross-polarized antenna of claim 1, wherein the first and second feed points of the first driven patch are equidistant from a center of the first driven patch, and the first and second feed points of the second driven patch are equidistant from a center of the second driven patch.

3. The dual-band cross-polarized antenna of claim 2, wherein the first driven patch, the second driven patch, and the shared parasitic patch are square.

4. The dual-band cross-polarized antenna of claim 3, wherein the first driven patch has a length of 2.5 mm to 3.0 mm, the second driven patch has a length of 1.5 mm to 2.0 mm, and the shared parasitic patch has a length of 1.5 mm to 2.0 mm.

5. The dual-band cross-polarized antenna of claim 1, further comprising a third metal layer at a third distance from the RF ground plane, the third metal layer defining a shared parasitic patch configured to radiate according to a current induced by inductive and capacitive coupling between the shared parasitic patch and the first and second driven patches.

6. The dual-band cross-polarized antenna of claim 1, wherein the first metal layer further defines one or more first parasitic patches configured to radiate according to a current induced by inductive and capacitive coupling between the one or more second parasitic patches and the first driven patch.

7. The dual-band cross-polarized antenna of claim 6, wherein the first driven patch is square, and the one or more first parasitic patches comprise four first parasitic patches respectively arranged adjacent to the four sides of the first driven patch.

8. The dual-band cross-polarized antenna of claim 1, wherein the second metal layer further defines one or more second parasitic patches configured to radiate according to a current induced by inductive coupling between the one or more second parasitic patches and the second driven patch.

9. The dual-band cross-polarized antenna of claim 8, wherein the second driven patch is square, and the one or more second parasitic patches comprise four second parasitic patches respectively arranged adjacent to the four sides of the second driven patch.

10. The dual-band cross-polarized antenna of claim 1, further comprising:

a first catch pad, disposed in the first hole, through which the third feed pin extends; and a second catch pad, disposed in the second hole, through which the fourth feed pin extends;

wherein a diameter of the first catch pad, a diameter of the first hole, a diameter of the second catch pad, and a diameter of the second hole are tuned to achieve an input return loss at the second frequency of less than −10 dB.

11. The dual-band cross-polarized antenna of claim 1, further comprising a ground feed pin connecting the RF ground plane to the first driven patch and the second driven patch.

12. The dual-band cross-polarized antenna of claim 1, wherein the first and second feed lines are formed in one or more metal layers of a multi-layer printed circuit board (PCB) comprising the RF ground plane.

13. The dual-band cross-polarized antenna of claim 12, wherein the first, second, third, and fourth feed pins extend through respective holes in the RF ground plane.

14. The dual-band cross-polarized antenna of claim 12, further comprising an RF front end integrated circuit disposed on an opposite side of the multi-layer PCB from the first and second metal layers, one or more signal output pins of the RF front end integrated circuit being connected to the first and second feed lines.

15. An antenna module comprising:

a multi-layer printed circuit board (PCB) including a radio frequency (RF) ground plane;

a first metal layer at a first distance from the RF ground plane, the first metal layer defining a first driven patch configured to radiate at a first frequency;

a second metal layer at a second distance from the RF ground plane, the second metal layer defining a second driven patch configured to radiate at a second frequency greater than the first frequency;

a first feed pin connecting a first feed line to the first driven patch at a first feed point thereof associated with a first polarization of the first driven patch, the first feed line being formed in one or more metal layers of the multi-layer PCB;

a second feed pin connecting the first feed line to the first driven patch at a second feed point thereof associated with a second polarization of the first driven patch orthogonal to the first polarization;

a third feed pin connecting a second feed line to the second driven patch at a first feed point thereof associated with a first polarization of the second driven patch, the second feed line being formed in the one or more metal layers of the multi-layer PCB, the third feed pin extending through a first hole in the first driven patch to capacitively couple the third feed pin to the first driven patch; and a fourth feed pin connecting the second feed line to the second driven patch at a second feed point thereof associated with a second polarization of the second driven patch orthogonal to the first polarization, the fourth feed pin extending through a second hole in the first driven patch to capacitively couple the fourth feed pin to the first driven patch;

an RF front end integrated circuit disposed on an opposite side of the multi-layer PCB from the first and second metal layers, one or more signal output pins of the RF front end integrated circuit being connected to the first and second feed lines; and a package containing the first and second metal layers, the first, second, third, and fourth feed pins, and the multi-layer PCB including the RF ground plane and the one or more metal layers forming the first and second feed lines, the RF front end integrated circuit being mounted on the package, and an outer surface of the package having conductive contacts for routing input signals through the multi-layer PCB to one or more signal input pins of the RF front end integrated circuit.

16. A dual-band cross-polarized phased array antenna comprising:

two or more antenna elements arranged in an array, each of the antenna elements comprising:

a first driven patch configured to radiate at a first frequency, the first driven patch defined in a first metal layer at a first distance from a radio frequency (RF) ground plane;

a second driven patch configured to radiate at a second frequency greater than the first frequency, the second driven patch defined in a second metal layer at a second distance from the RF ground plane;

a first feed pin connecting a first feed line to the first driven patch at a first feed point thereof associated with a first polarization of the first driven patch;

a second feed pin connecting the first feed line to the first driven patch at a second feed point thereof associated with a second polarization of the first driven patch orthogonal to the first polarization;

a third feed pin connecting a second feed line to the second driven patch at a first feed point thereof associated with a first polarization of the second driven patch, the third feed pin extending through a first hole in the first driven patch to capacitively couple the third feed pin to the first driven patch; and a fourth feed pin connecting the second feed line to the second driven patch at a second feed point thereof associated with a second polarization of the second driven patch orthogonal to the first polarization, the fourth feed pin extending through a second hole in the first driven patch to capacitively couple the fourth feed pin to the first driven patch.

17. The dual-band cross-polarized phased array antenna of claim 16, wherein a distance $D_A$ between centers of the antenna elements is between 0.3 and 0.4 times a free space wavelength $\lambda_0$ of the first frequency.

18. The dual-band cross-polarized phased array antenna of claim 16, wherein the two or more antenna elements are arranged in a two-by-two array.

19. The dual-band cross-polarized phased array antenna of claim 16, wherein the two or more antenna elements are arranged in a four-by-one array.

20. The dual-band cross-polarized phased array antenna of claim 16, further comprising:

a multi-layer printed circuit board (PCB) including the RF ground plane and one or more metal layers forming the first and second feed lines;

an RF front end integrated circuit disposed on an opposite side of the multi-layer PCB from the two or more antenna elements, one or more signal output pins of the RF front end integrated circuit being connected to the first and second feed lines; and a package containing the two or more antenna elements and the multi-layer PCB, the RF front end integrated circuit being mounted on the package;

wherein an outer surface of the package has conductive contacts for routing input signals through the multi-layer PCB to one or more signal input pins of the RF front end integrated circuit.

* * * * *